US005753848A

United States Patent [19]

Kart

[11] Patent Number: 5,753,848

[45] Date of Patent: May 19, 1998

[54] SEMI-AUTOMATIC PISTOL BARREL WITH PRECISION ADJUSTMENT MEANS AND METHOD OF PRECISION-ADJUSTING SEMI-AUTOMATIC PISTOLS

[76] Inventor: Frederick H. Kart, 1697 Lawndale Dr., Shallotte, N.C. 28470

[21] Appl. No.: 679,459

[22] Filed: Jul. 9, 1996

[51] Int. Cl.[6] ..... F41A 5/04

[52] U.S. Cl. ..... 89/163

[58] Field of Search ..... 89/163, 196, 199

[56] References Cited

U.S. PATENT DOCUMENTS

| | | | |
|---|---|---|---|
| 2,489,816 | 11/1949 | Reilly | 89/163 |
| 2,776,602 | 1/1957 | Sturtevant | 89/196 |
| 3,158,604 | 11/1964 | Charron | 89/196 |
| 3,252,237 | 5/1966 | Korzeniewski | 89/163 |
| 4,031,808 | 6/1977 | Raville | 89/163 |

FOREIGN PATENT DOCUMENTS

| | | | |
|---|---|---|---|
| 2094450 | 9/1982 | United Kingdom | 89/163 |

*Primary Examiner*—Stephen M. Johnson
*Attorney, Agent, or Firm*—Adams Law Firm, P.A.

[57] ABSTRACT

In a barrel of a semi-automatic pistol, the barrel having fore and aft barrel locking grooves for locking into corresponding fore and aft slide assembly wall segments formed in a slide mounted on a receiver of the pistol when the barrel is in its lock-up position, the improvement comprising adjustment means for precision-fitting the barrel to the dimensions and tolerances of the slide and the receiver of the pistol. The barrel includes a pair of raised contact pads integrally-formed in laterally-spaced relation in the aft locking groove of the barrel to provide an initial vertical interference fit between the aft locking groove of the barrel and the aft locking wall segment of the slide. The contact pads are adapted for incremental trial-and-error removal until a just-sufficient amount material from one or both of the contact pads has been removed to cause the barrel to move into the proper lock-up position with lock-up pressure transferred onto the top of a slide stop pin on which the barrel is pivotally mounted with the barrel locking grooves intimately engaged with the aft locking wall segment of the slide assembly.

9 Claims, 7 Drawing Sheets

SEMI-AUTOMATIC PISTOL BARREL WITH PRECISION ADJUSTMENT MEANS AND METHOD OF PRECISION-ADJUSTING SEMI-AUTOMATIC PISTOLS

TECHNICAL FIELD AND BACKGROUND OF THE INVENTION

This invention relates to firearms and more particularly to semi-automatic, or autoloading pistols. A very popular model of semi-automatic pistol is the U.S. caliber 0.45 model 1911 pistol as made by Colt, Remington, Ithaca Gun Company and others with an estimated several million having been made from 1911 to date. Other autoloading pistols of generally similar design are the Browning Model P35, the Smith and Wesson Model 39, the Polish Radom and the Russian M1933 Tokarev. In general, the invention has application to any semi-automatic 45, 40 or 38 caliber pistol, as well as 9 and 10 mm pistols, such as the 9 mm Beretta currently used by the United States and some other NATO armed forces, in which the barrel is moved into a battery, or lock-up, position by means of a lug link or camming surface.

In all of these pistols the barrel and slide are separate parts with the barrel unlocking itself from the slide, which includes the bolt, as the slide moves to the rear in response to a firing. This design inherently causes a heavy recoil and firing inaccuracy because the barrel and sights are not integral. Moreover, because many of these weapons are made to be used in combat circumstances where fouling by dirt, grease and other contaminants may occur without the opportunity for frequent cleaning, tolerances between critical operating parts such as the shell ejection opening and barrel hood, the barrel and receiver housing, and the barrel and slide locking grooves are deliberately greater than necessary to achieve optimum firing accuracy and reliability in order to permit operation even when fouled, and to permit easy field disassembly and repair.

A standard 45 caliber Colt when properly adjusted with no worn or damaged parts when bench fired will hit a target at 50 feet with a spread of approximately 6 inches (15 cm). The barrel of such a handgun is actually permitted to move a few thousandths of an inch during firing and is not held rigid. A few thousandths of an inch movement of the barrel easily results in a several inch variation in movement of the projectile at fifty feet. This means that only chance will result in a firing pattern significantly tighter than 6 inches (15 cm). Manufacturing variations between components of various manufacturers and rebuilders also introduce a further degree of inaccuracy into the operation of the pistol.

The continuing popularity and availability of these pistols has resulted in their use for sport target competition, and as weapons for special military and police units where enhanced accuracy is necessary or desirable. It has been observed that three factors are principally responsible for inherent design inaccuracy in a 45 caliber pistol—the fit of the barrel hood of the barrel into the shell ejection opening and the fit of the aft barrel locking groove onto the aft slide locking wall segment and the fit of the link and link lug to the slide stop pin. This application addresses these design features, particularly proper fitting of the aft barrel locking groove with the slide locking wall segment to achieve significantly greater accuracy.

SUMMARY OF THE INVENTION

Therefore, it is an object of the invention to provide a barrel for a semi-automatic pistol which permits its precise adjustment to the particular tolerances of any given pistol for which it is intended.

It is another object of the invention to provide a barrel for a semi-automatic pistol which has raised pads formed in one of the barrel locking grooves to permit adjustment of the barrel to a particular pistol.

It is another object of the invention to provide a barrel for a semi-automatic pistol which can be retrofitted into a pistol with improved fit tolerances and firing accuracy.

It is another object of the invention to provide a barrel for a semi-automatic pistol which permits a conventionally-manufactured pistol with relatively large tolerances and variations in component fit to be "accurized" for use as a target pistol or for other uses requiring enhanced accuracy.

These and other objects of the present invention are achieved in the preferred embodiments disclosed below by providing in a barrel of a semi-automatic pistol, the barrel having fore and aft barrel locking grooves for locking into corresponding fore and aft slide assembly wall segments formed in a slide mounted on a receiver of the pistol when the barrel is in its lock-up position, the improvement comprising adjustment means for precision-fitting the barrel to the dimensions and tolerances of the slide and the receiver of the pistol. The barrel comprises a pair of raised contact pads integrally-formed in laterally-spaced relation in the aft locking groove of the barrel to provide an initial vertical interference fit between the aft locking groove of the barrel and the aft locking wall segment the slide. The contact pads are adapted for incremental trial-and-error removal until a just-sufficient amount material from one or both of the contact pads has been removed to cause the barrel to move into the proper lock-up position with lock-up pressure transferred onto the top of a slide stop pin on which the barrel is pivotally mounted with the barrel locking grooves intimately engaged with the wall segments of the slide assembly.

According to one preferred embodiment of the invention in a barrel of a semi-automatic pistol, the barrel has fore and aft barrel locking grooves for locking onto corresponding fore and aft slide assembly locking wall segments formed in a slide mounted on a receiver of the pistol when the barrel is in its lock-up position. The improvement comprises adjustment means for precision-fitting the barrel to the dimensions and tolerances of the slide and the receiver of the pistol. The barrel comprises a pair of raised contact pads integrally-formed in laterally-spaced relation in the aft locking groove of the barrel to provide an initial interference fit between the aft locking groove of the barrel and the aft locking wall segment of the slide. The contact pads are adapted for incremental trial-and-error removal until a just-sufficient amount of the contact pads has been removed to cause a lug link rotatably-positioned on the barrel to rotate the barrel into the proper lock-up position with lock-up pressure transferred onto the top of a slide stop pin on which the lug link is pivotally mounted.

According to one preferred embodiment of the invention, the contact pads each have a longitudinal axis parallel to the longitudinal axis of the barrel.

According to another preferred embodiment of the invention, the contact pads extend the entire fore-and-aft dimension of the aft locking groove.

According to yet another preferred embodiment of the invention, the contact pads define a generally cylindrical upper surface, an apex of the upper surface being below the surface of the surrounding portions of the barrel.

An embodiment of the method according to the invention comprises a method of precision-fitting a barrel of a semi-automatic pistol into a receiver and slide of the pistol. The barrel has fore and aft barrel locking grooves for locking onto corresponding fore and aft slide locking wall segment formed in the slide mounted on a receiver of the pistol. The slide includes a shell-ejection opening in the top thereof, the shell-ejection opening including a hood recess for receiving a hood portion of the barrel therein. The method comprises the steps of providing a pair of raised contact pads integrally-formed in laterally-spaced relation in the aft locking groove of the barrel to provide an initial interference fit between the aft locking groove of the barrel and the aft locking wall segment of the slide. The barrel is fitted into the slide of the pistol and the slide is placed onto the receiver. A contact disclosing material is applied to the contact pads, and the slide is forced into a position relative to the receiver wherein the contact pads are forced into contact with the aft locking wall segment of the slide. The barrel is removed from the slide and material is removed from the contact pads at each place where the contact disclosing material indicates contact between the contact pad and the aft locking wall segment of the slide occurred when the contact pads were forced into contact with the aft locking wall segment of the slide.

The steps of the method are repeated to achieve incremental trial-and-error removal of the material of the contact pad until a just-sufficient amount of the contact pads has been removed to cause the lug link rotatably-positioned on the barrel to rotate the barrel into the proper lock-up position with lock-up pressure transferred onto the top of a slide stop pin on which the lug link is pivotally mounted.

According to one preferred embodiment of the invention, the material is removed from the contact pad with a metal file.

According to another preferred embodiment of the invention, the method includes the step of adjusting the fit of the hood of the barrel into the hood recess of the shell ejection opening wherein a clearance between the hood recess and the hood exists on both sides of the hood.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
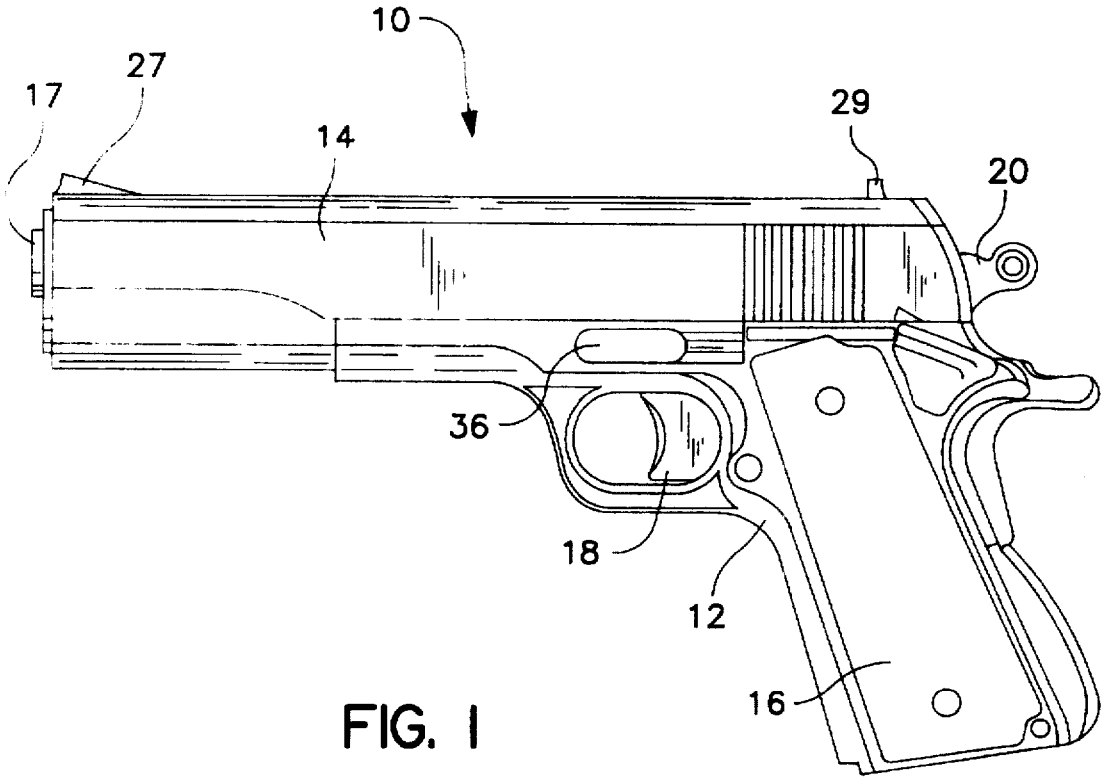
FIG. 1 is a side elevation of a U.S. caliber 0.45 model 1911 semi-automatic pistol.
Figure 2:
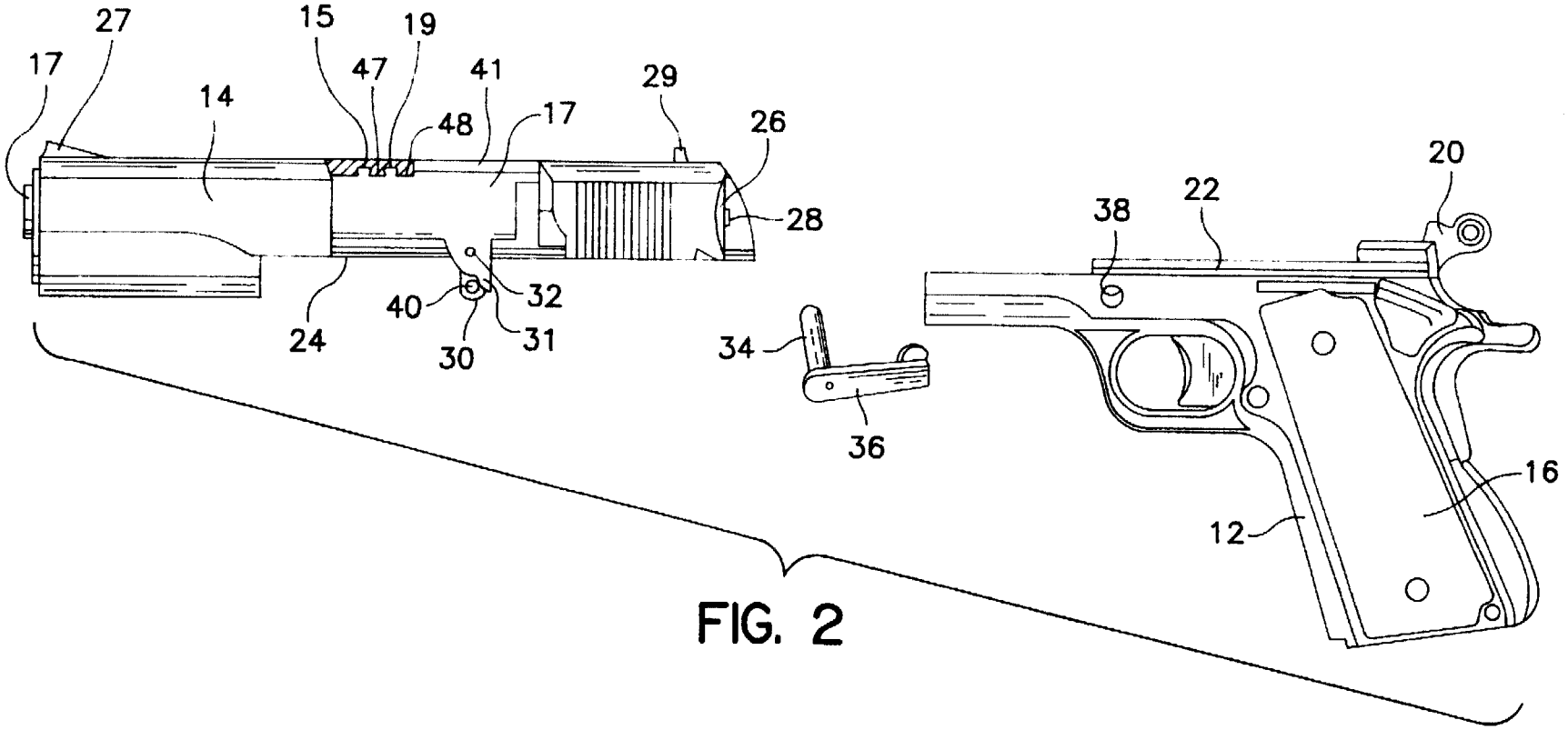
FIG. 2 is a partially-exploded view of the pistol shown in FIG. 1, with the slide removed from the receiver.

Referring now specifically to the drawings, a 45 caliber semi-automatic pistol of conventional manufacture is illustrated in FIGS. 1 and 2 and shown generally at reference numeral 10. Pistol 10 is broadly formed of a receiver 12, slide 14, and barrel 17. The receiver 12 has a grip 16 and carries a trigger mechanism including a trigger 18 and hammer 20, as well as a magazine 21 (FIG. 4) which holds cartridges to be fed one-by-one into the firing chamber of the pistol.

Referring now specifically to FIG. 2, the slide 14 of the pistol 10 is supported on the receiver 12 for fore-to-aft sliding movement by a pair of longitudinally extending guide rails 22 on the receiver and a matching pair of guide rails 24 on the slide. The slide 14 has a bolt 26 rigidly, that is immovably, fixed to it carrying a firing pin 28 for cooperation with the hammer 20. Front and rear sights 27 and 29 are integral with the slide.

The barrel 17 is slidable and tiltable relative to the slide 14 and is connected to the receiver 12 through a link 30 pivotally connected to an integrally-formed link lug 31 formed on the barrel 17 by a pin 32. The barrel 17 is also pivotally connected to the receiver 12 by a pin 34 of a slide stop 36.

Figure 3:
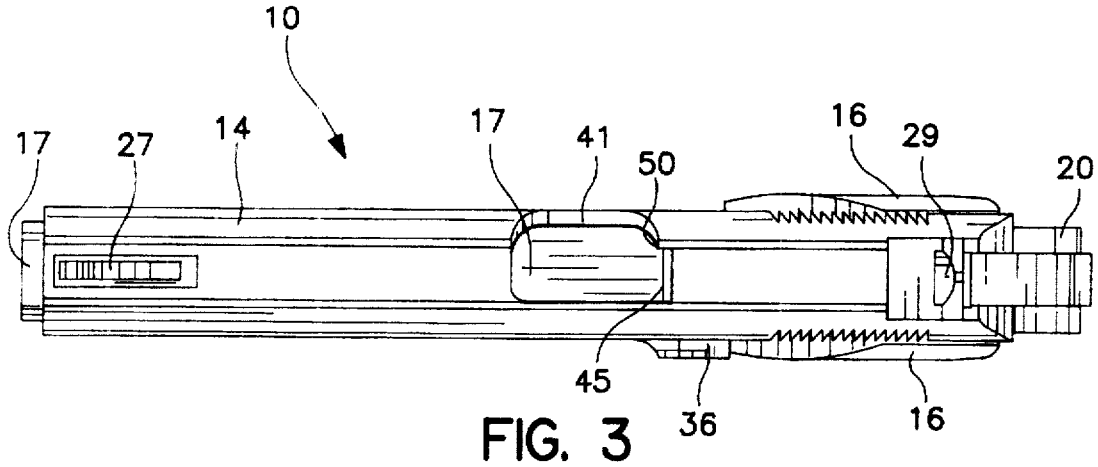
FIG. 3 is a is a top plan view of the pistol shown in FIG. 1.
Figure 4:
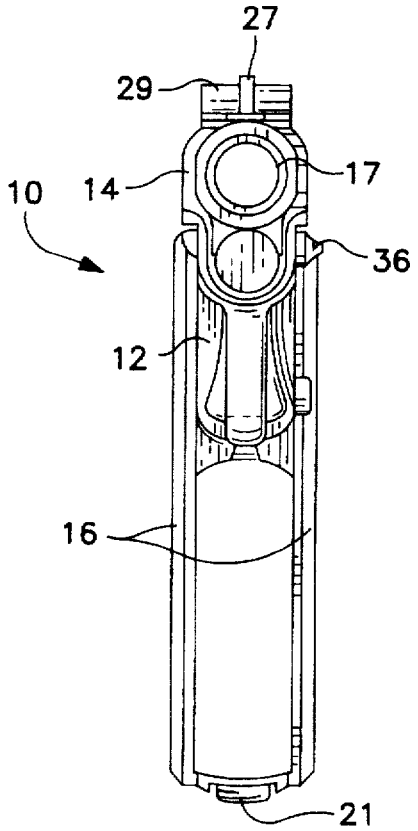
FIG. 4 is a front elevation of the pistol shown in FIG. 1.

Thus, in the assembled condition of the pistol 10, as seen in FIG. 1, the pin 34 of the slide stop 36 extends through a pair of holes, only one of which is shown at 38 in FIG. 2, in the sidewalls of the receiver 12 and through an pin-receiving hole 40 in the lower end of the link 30. Other views of the pistol are shown in FIGS. 3 and 4. Note particularly the shell-ejection opening 41 in the top of the slide 14, through which barrel 17 is visible. A hood recess 45 is formed in the aft end of shell-ejection opening 41.

The pistol 10 is disassembled to the state shown in FIG. 2 by removing the slide stop 36 from the receiver 12 and sliding the slide 14 along with the barrel 17 along the guide rails 22 until it slides free of the receiver 12. The recoil spring, recoil spring plug and recoil spring guide (not shown) are also removed from the receiver along with the slide 14.

Figure 5:
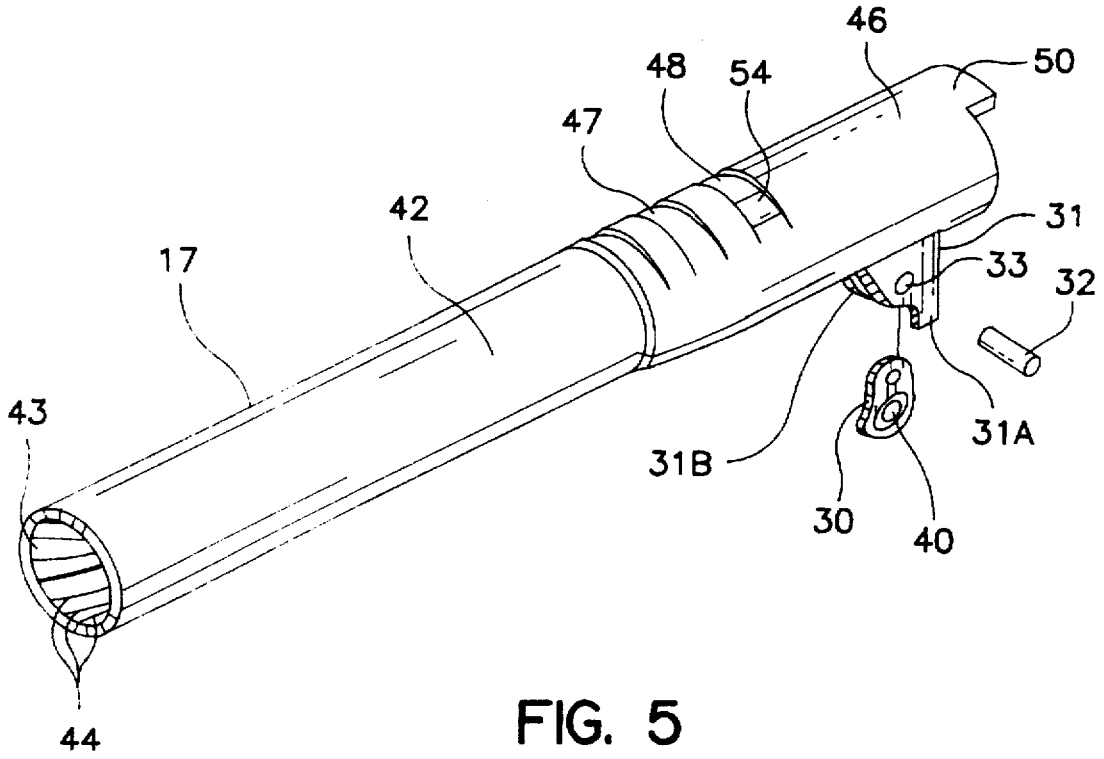
FIG. 5 is perspective view of the pistol barrel according to an embodiment of the present invention, with parts broken away for clarity.

Referring now to FIG. 5, the barrel 17 is shown in further detail. Barrel 17 includes a cylindrical barrel portion 42 having a central bore 43 with rifling grooves 44. An enlarged and integrally-formed locking portion 46 carries fore and aft locking grooves 47 and 48, and an aft-extending hood 50. As is best shown in FIG. 3, the hood 50 fits into the hood recess 45 of the shell-ejection opening 41 and is oriented to dead top center.

The link lug 31 of the barrel 17 is formed of two laterally-spaced link lug legs 31A, 31B which support between them the link 30. As also shown in FIG. 5, the link 30 is pivotally mounted onto the link lug legs 31A, 31B by pin 32 positioned in a pin receiving hole 33.

The slide 14 includes a pair of fore-and-aft locking grooves 15 and 19 formed in the interior walls of the slide 14 into which the barrel 17 fits. Areas of the interior walls of the slide 14 adjacent the locking grooves 15 and 19 define wall segments which fit into the barrel locking grooves 47 and 48.

Figure 6:
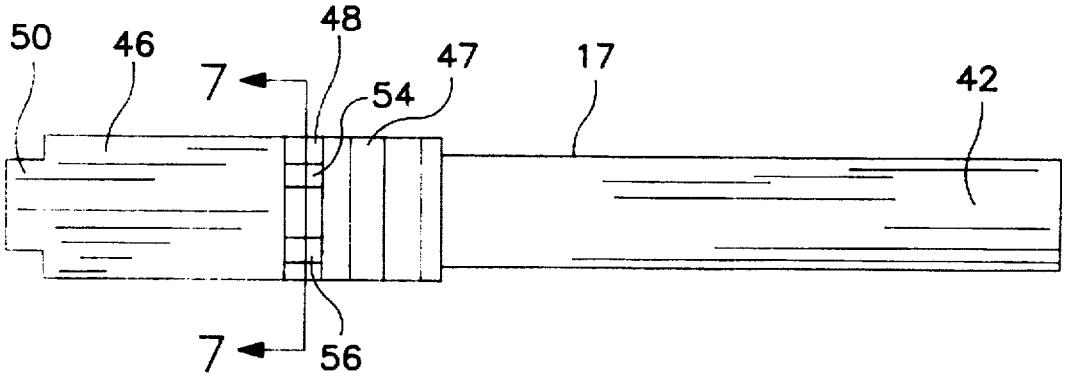
FIG. 6 is a top plan view of the barrel shown in FIG. 5.
Figure 7:
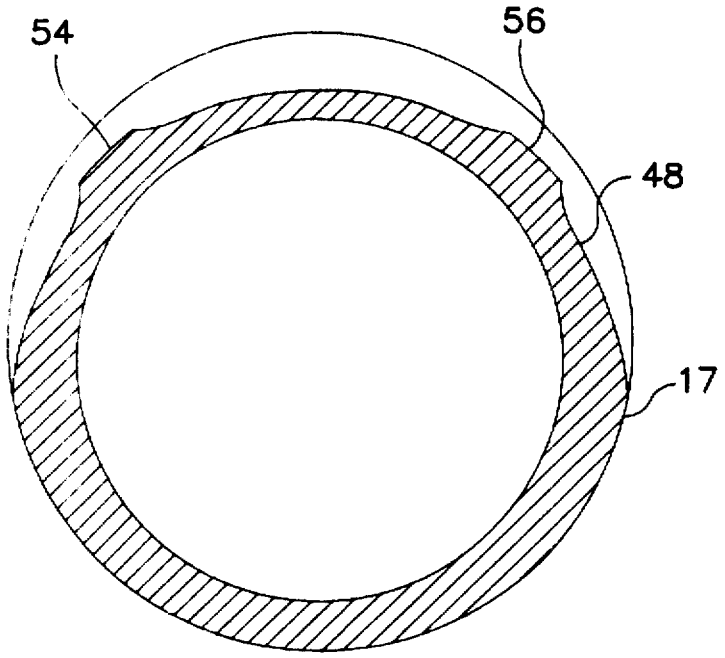
FIG. 7 is a vertical cross-section taken through section 7—7 of FIG. 6.

As is best shown in FIGS. 5 and 6, the aft barrel locking groove 48 includes a pair of laterally-spaced contact pads 54, 56. These pads 54, 56 are integrally-formed in the barrel during machining. The pads 54, 56 are raised above the annular surface of the groove 48 and extend the fore-to-aft dimension of the groove 48. The contact pads 54, 56 each span an arc of 15 degrees, and from centerline-to-centerline are 90 degrees of arc on radii from the longitudinal centerline axis of the barrel 17. The general configuration of the contact pads 54, 56 are shown in greatly enlarged scale in FIG. 7.

In the embodiment of the invention disclosed in this application, which for illustration purposes refers to a 45 caliber Colt model 1911 pistol, the barrel locking grooves are each 0.058 inches (1.47 mm) deep, and the contact pads extend upwardly from the base of the groove 0.015 inches (0.38 mm).

The manner of operation of the Colt 45 semi-automatic pistol is well known in the art. In general this weapon is a blowback type, wherein during firing the blowback pressure exerted by the cartridge shell on the bolt is used to operate the bolt, during the course of which operation the bolt is unlocked for movement relative to the barrel, the spent shell ejected, the hammer cocked, a new cartridge brought to the firing chamber, and the bolt returned to locked firing position.

During firing the barrel 17 is locked against movement by the cooperation of the locking wall segments 15 and 19 of slide 14 and the locking grooves 47 and 48 of barrel 17. During shell ejection and shell loading, the barrel 17 is unlocked from the locking wall segments 15 and 19, and pivots downwardly to receive the next cartridge from the magazine.

Full "accurization" of a Colt 45 semi-automatic pistol as described in this application includes three basic procedures:

1. properly fitting the hood 50 of the barrel 17 to the hood recess 45;
2. properly fitting the locking grooves 47 and 48 of the barrel 17 onto the mating locking wall segments 15, 19 of the slide 14; and
3. fitting the link lug 30 for proper camming action against the pin 34 of the slide stop 36.

These procedures remove excessive tolerances from the pistol as conventionally manufactured, substantially increase the accuracy of the pistol and substantially reduce wear.

Fitting the Hood

The pistol is disassembled by removing the stop pin 36 which releases the link 30 from attachment to the receiver 12. The slide 14 and the production barrel can then be slid off of the front of the receiver 12. The barrel bushing on the front of the slide 14 is turned and removed, and the production barrel is slid out of the front of the slide 14 and set aside. A barrel 17 according to the present invention is then placed into the slide 14 using a "bench bushing", known in the art, to permit easy installation and removal as the barrel 17 is being fitted.

A link lug locating block is slid onto the barrel 17 to keep the link lug legs 31A, 31B properly located in the slide 14. In this position the hood 50 of barrel 17 is observed in relation to the hood recess 45 of the shell-ejection opening 41. If the hood 50 is too wide to fit into the hood recess 45, the barrel is held with the link lug locating block and held towards a light source. If no light is seen on one or both sides of the hood 50 between it and the side walls of the hood recess 45, the hood 50 is filed with a fine metal file until there is a minimum 0.002 inch (0.05 mm) clearance on both sides. A metal file suitable for carrying out this procedure is a No. 2 double cut Swiss Pattern flat needle file, 0.175 inches (4.4 mm) wide with the edge grooves removed.

After the hood 50 has been sized to fit into the hood recess 45, material is removed from the back wall of the hood with a file until the locking grooves 47 and 48 on the barrel 17 are in proper horizontal alignment with the locking wall segments 15, 19 of the slide 14. Contact pads 54 and 56 will touch the walls of the slide 14 aft of the locking wall segment 19 of slide 14 at the shell ejection opening 41.

Fitting the Aft Locking Groove of the Barrel onto the Aft Locking Wall Segment of the Slide When the barrel 17 has been fitted as described above, the slide 14 and the barrel 17 are placed back on the receiver 12. Ordinarily the barrel 17 will not go into a full lock-up firing position because of the thickness of the contact pads 54, 56 bearing against the slide 14 adjacent the slide locking groove 19. A contact disclosing material, such as "bearing blue" is applied to the contact pads 54 and 56. The barrel 17 is then forced into its battery position, where the wall segments of the slide 14 15 and 19 will attempt to mate with the locking grooves 47 and 48.

The barrel is then removed, and the appearance of the contact pads 54 56 is observed. The contact disclosing material is absent from the points of contact of the contact pads 54, 56 and the slide 14. Material is then carefully removed with a file from the contact pads 54, 56 where contact was noted. More contact disclosing material is applied to the remaining areas of the contact pads 54, 56 and the above steps are repeated as often as necessary until the locking grooves 47, 48 and wall segment 19 properly mate so that the barrel 17 fits precisely into firing position.

When this degree of precision has been achieved, the link 30 will rotate the barrel 17 into an exact lock-up position with the lock-up pressure transferred onto the top surface of the slide stop pin 34.

Figure 8:
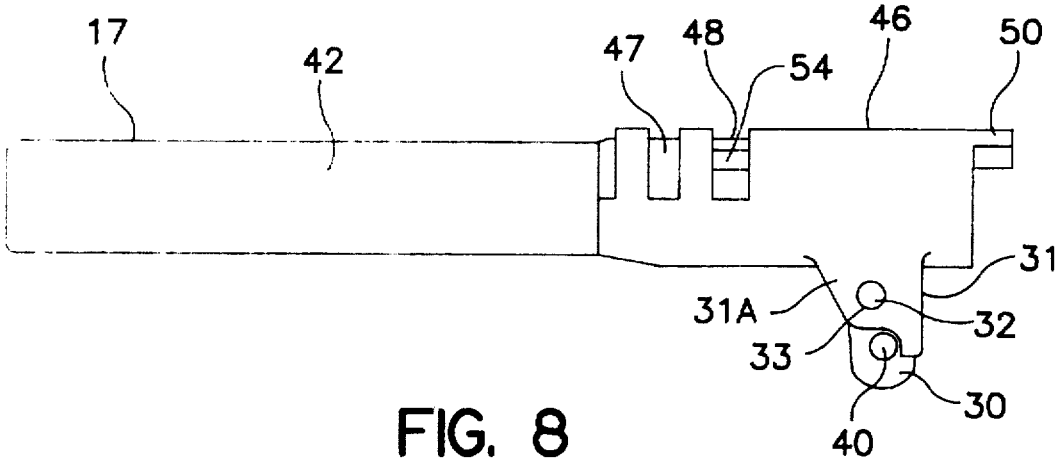
FIG. 8 is a side elevation of the barrel shown in FIG. 6.
Figure 9:
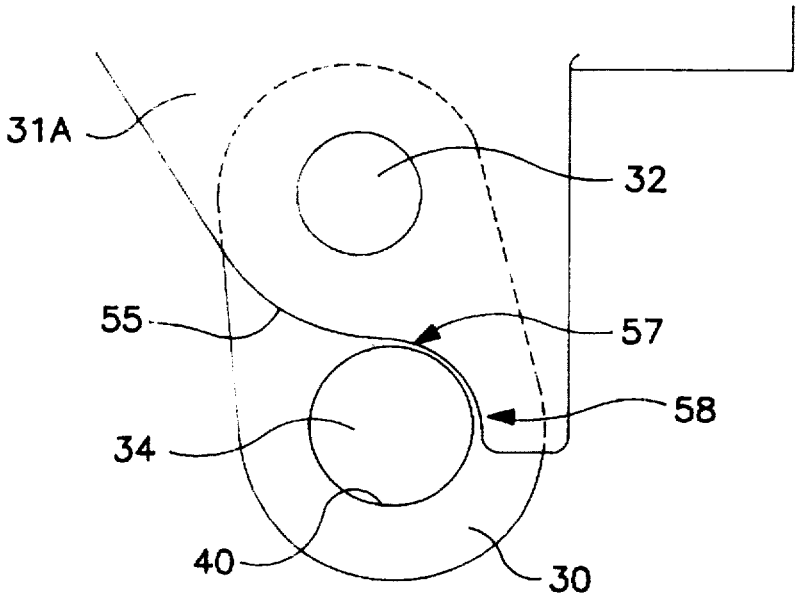
FIG. 9 is an enlarged fragmentary view of the link lug and link parts of the barrel.

Fitting the Link Lug for Proper Camming Action against the Pin of the Slide Stop The link 30 is shown in FIGS. 8 and 9. The geometry of the forward curved wall 55 of the link lug 31 is optimized so that the camming action of the barrel 17 into full lock-up position occurs without jamming. As is shown in FIG. 9, in full lock-up position the slide stop pin 34 has two points of contact with wall 55, which are approximately 90 degrees apart, as indicated at reference numerals 57 and 58. Between these points of contact is a crescent-shaped void approximately 0.007 inch (0.18 mm) at the point equidistant between contact points 57 and 58.

A semi-automatic pistol barrel with precision adjustment means and method of precision-adjusting semi-automatic pistols is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. In a barrel of a semi-automatic pistol, the barrel having fore and aft barrel locking grooves for locking into corresponding fore and aft slide assembly locking wall segments formed in a slide mounted on a receiver of the pistol when the barrel is in its lock-up position, the improvement comprising adjustment means for precision-fitting the barrel to the dimensions and tolerances of the slide and the receiver of the pistol, said adjustment means comprising:

a pair of raised contact pads integrally-formed in laterally-spaced relation in the aft locking groove of the barrel to provide an initial vertical interference fit between the aft locking groove of the barrel and the aft locking wall segment of the slide, said contact pads adapted for incremental trial-and-error removal until a just-sufficient amount material from one or both of said contact pads has been removed to cause said barrel to move into the proper lock-up position with lock-up pressure transferred onto the top of a slide stop pin on which said barrel is pivotally mounted with said fore and aft barrel locking grooves intimately engaged with the slide assembly locking wall segments.

2. In a barrel of a semi-automatic pistol, the barrel having fore and aft barrel locking grooves for locking into corresponding fore and aft slide assembly locking wall segments formed in a slide mounted on a receiver of the pistol when the barrel is in its lock-up position, the improvement comprising adjustment means for precision-fitting the barrel to the dimensions and tolerances of the slide and the receiver of the pistol, said adjustment means comprising:

a pair of raised contact pads integrally-formed in laterally-spaced relation in the aft locking groove of the barrel to provide an initial interference fit between the aft locking groove of the barrel and the aft locking wall segment of the slide, said contact pads adapted for incremental trial-and-error removal until a just-sufficient amount of said contact pads has been removed to cause a lug link rotatably-positioned on said barrel to rotate said barrel into the proper lock-up position with lock-up pressure transferred onto the top of a slide stop pin on which said lug link is pivotally mounted.

3. In a barrel of a semi-automatic pistol according to claim 1 or 2, wherein said contact pads each have a longitudinal axis parallel to the longitudinal axis of the barrel.

4. In a barrel of a semi-automatic pistol according to claim 1 or 2, wherein said contact pads extend the entire fore-and-aft dimension of the aft locking groove.

5. In a barrel of a semi-automatic pistol according to claim 1 or 2, wherein said contact pads define a generally cylindrical upper surface, an apex of said upper surface being below the surface of the surrounding portions of the barrel defining the aft locking groove of the barrel.

6. A method of precision-fitting a semi-automatic pistol barrel into a receiver and slide of a semi-automatic pistol, the barrel having fore and aft barrel locking grooves for locking into mating fore and aft slide assembly locking wall segments formed in the slide mounted on said receiver of the pistol, said slide including a shell-ejection opening in the top thereof, said shell-ejection opening including a hood recess for receiving a hood portion of the barrel therein, said method comprising the steps of:

(a) providing a pair of raised contact pads integrally-formed in laterally-spaced relation in the aft locking groove of the barrel to provide an initial interference fit between the aft locking groove of the barrel and the corresponding locking wall segment of the slide;

(b) fitting said barrel into the slide of the pistol;

(c) placing the slide onto the receiver;

(d) applying a contact disclosing material to the contact pads;

(e) forcing the barrel into a position relative to the slide wherein the contact pads are forced into contact with the aft wall segment of the slide;

(f) removing the barrel from the slide;

(g) removing material from the contact pads at each place where the contact disclosing material indicates contact between the contact pad and the aft wall segment of the slide;

(h) repeating steps (b)–(g) to achieve incremental trial-and-error removal of the material of the contact pad until a just-sufficient amount of said contact pads has been removed to cause said barrel to rotate into the proper lock-up position with lock-up pressure transferred onto the top of a slide stop pin on which said barrel is pivotally mounted.

7. A method according to claim 6, wherein the step of removing material from the contact pad comprises removing the material with a metal file.

8. A method according to claim 6, and including the step of adjusting the fit of the hood portion of the barrel into the hood recess of the shell ejection opening wherein a clearance between the hood recess and the hood portion exists on both sides of said hood portion.

9. A method according to claim 6, 7, or 8 wherein said method steps are carried out on a Colt 45 caliber semi-automatic pistol.

* * * * *

UNITED STATES PATENT AND TRADEMARK OFFICE

CERTIFICATE OF CORRECTION

PATENT NO. : 5,753,848

DATED : May 19, 1998

INVENTOR(S) : Kart, Frederick H.

It is certified that error appears in the above-identified patent and that said Letters Patent is hereby corrected as shown below:

Title page, item [57], Abstract: Line 15, delete "cause" and insert --allow--.

Column 5, line 31, delete "30" and insert --31--.
Column 8, claim 6, line 27, delete "cause" and insert --allow.

Signed and Sealed this

Twenty-second Day of September, 1998

*Attest:*

Bruce Lehman

BRUCE LEHMAN

*Attesting Officer*

*Commissioner of Patents and Trademarks*